United States Patent [19]

Picollo et al.

[11] Patent Number: 4,957,268

[45] Date of Patent: Sep. 18, 1990

[54] DISPOSABLE CURB INLET DRAIN FORM

[76] Inventors: August J. Picollo, 628 Beebe Rd., Central Point, Oreg. 97501; Alfred N. Guillemette, 560 13th St., Gold Hill, Oreg. 97525

[21] Appl. No.: 282,963

[22] Filed: Nov. 30, 1988

Related U.S. Application Data

[63] Continuation of Ser. No. 56,867, Jun. 1, 1987, abandoned.

[51] Int. Cl.[5] ..... E02D 29/12; B28B 7/34

[52] U.S. Cl. ..... 249/10; 249/61; 249/83; 249/175; 264/317

[58] Field of Search ..... 249/1, 2, 10, 11, 61, 249/62, 83, 134, 145, 165, 175, 183; 264/221, 317; 164/34, 35, 45, 132, 246

[56] References Cited

U.S. PATENT DOCUMENTS

| | | | |
|---|---|---|---|
| 2,809,414 | 10/1957 | Mitchell | 249/1 |
| 3,250,189 | 5/1966 | Peletz | 404/5 |
| 3,436,051 | 4/1969 | Nakahara | 249/1 |
| 3,695,340 | 10/1972 | Gross | 164/246 |
| 3,831,897 | 8/1974 | Stegmeier | 249/1 |
| 3,844,073 | 10/1974 | Peletz | 52/20 |
| 3,847,339 | 11/1974 | Farrell | 249/1 |
| 3,861,447 | 1/1975 | Hondo | 164/34 |
| 4,085,918 | 4/1978 | Wilkerson | 249/11 |
| 4,119,291 | 10/1978 | Polito | 249/11 |
| 4,192,625 | 3/1980 | Peletz | 404/5 |
| 4,536,103 | 8/1985 | Prescott | 404/26 |
| 4,637,585 | 1/1987 | Picollo | 249/10 |

FOREIGN PATENT DOCUMENTS

| | | | |
|---|---|---|---|
| 746370 | 7/1970 | Belgium | 249/61 |
| 4410761 | 5/1969 | Japan | 164/34 |

OTHER PUBLICATIONS

"Using Patterned Form Liners" from Concrete Construction, 32:431–438, (May 1987).

*Primary Examiner*—James C. Housel
*Attorney, Agent, or Firm*—Klarquist, Sparkman, Campbell, Leigh & Whinston

[57] ABSTRACT

A disposable form for manufacturing curb inlet drains in situ includes a base for forming the main body of the curb inlet drain, and a neck for forming a manhole opening. The base is made of a frangible material that can be broken into pieces and removed from the drain after concrete is poured and sets around the form. In other embodiments, both the neck and base are made of a frangible material. The form is lightweight, inexpensive, and reduces the cost of manufacturing curb inlet drains in situ.

10 Claims, 1 Drawing Sheet

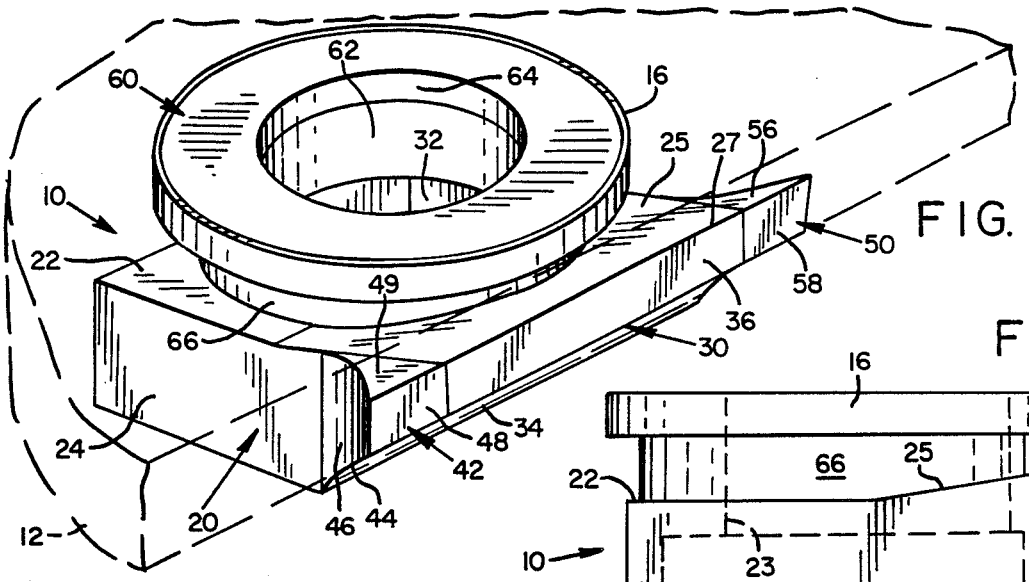
FIG. 1
FIG. 2
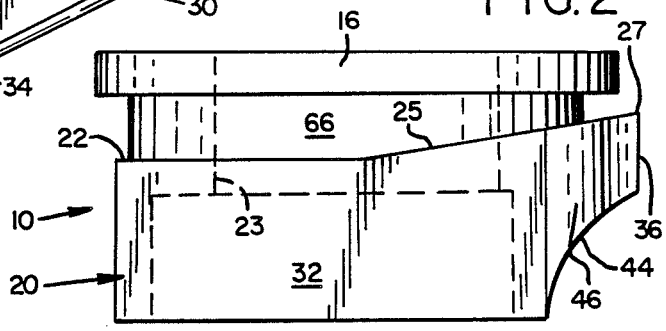
FIG. 3
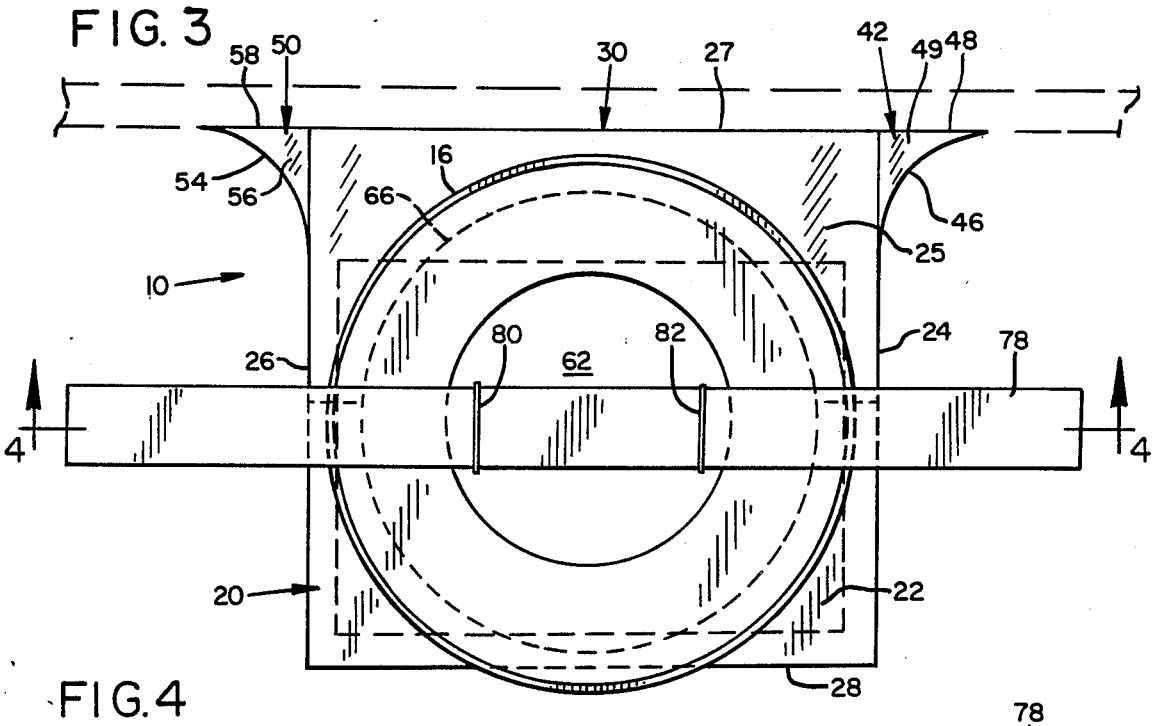
FIG. 4
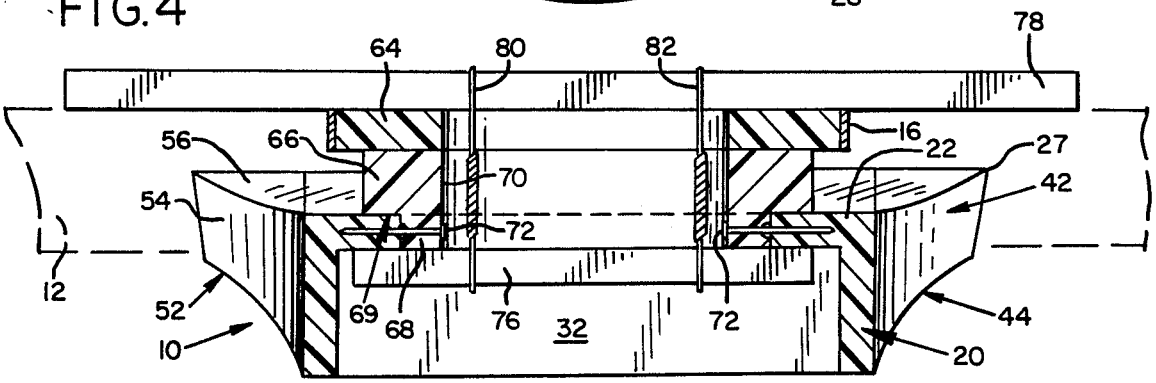

DISPOSABLE CURB INLET DRAIN FORM

This application is a continuation of application Ser. No. 07/056,867, filed June 1, 1987, now abandoned.

BACKGROUND OF THE INVENTION

The present invention relates to forms for use in manufacturing curb inlet drains for streets and the like. More particularly, the present invention relates to a disposable form for use in casting concrete curb inlet drains in situ.

One known prior art curb inlet drain form is of one piece and is fabricated out of fiberglass. These forms are positioned at the desired location of a curb inlet drain, concrete is poured around them to form the drain, and the forms are left in place. The form is not needed for structural strength, but simply cannot be readily removed. Such forms are presently made by relatively few manufacturers and must be shipped to a contractor for use at a construction site. This requires lead time and subjects the user to limitations on the ability of the manufacturers to meet demand. Moreover, at this time, such forms typically cost several hundred dollars, and such costs add to the price of a construction project.

In some localities, curb inlet drains are cast from on-site fabricated forms. Such forms are typically very costly because of the labor and time needed to construct them. These forms are usually made of exterior plywood which is oiled to permit removal of the form after the concrete has set. Also, such forms are typically destroyed in the process of removing them.

Another known approach is to utilize pre-cast concrete curb inlet drains. To make a pre-cast drain, concrete is poured into a mold which shapes the outer exterior surfaces of the drain. Pre-cast drains typically are extremely heavy, for example, about 500 pounds. For this reason, they cannot be readily handled without special equipment such as a boom truck. Also, the cost of shipping such pre-cast curb inlet drains to a construction site is high. In addition, these pre-cast drains are sometimes difficult to install, for example, to place them level, because of their weight. In addition, because the pre-cast curb inlet drains are typically manufactured away from a construction site, it is difficult for the pre-cast drain to match adjacent concrete which is poured at the site. For example, some differences in texture and coloration may be present which detract from the appearance of the completed construction project. Also, the face of the curb in different localities varies from sloped to vertical. It is sometimes difficult to order pre-cast concrete drain inlets with a curb face which meets the requirements of a particular construction project.

Still another prior art apparatus for forming concrete curb openings is shown in U.S. Pat. No. 2,809,414 of Mitchell. Mitchell discloses a form used in pouring concrete curb inlet openings in situ. Specifically, Mitchell is understood to describe a multi-piece form with pieces which are bolted together to complete the form. This form is removed for reuse by loosening the bolts, where necessary, to disassemble the form and permit its removal after the curb inlet drain has been poured and set sufficiently. In Mitchell, a plate 50 is removed through the mouth of the curb inlet while other pieces are apparently lifted upwardly through a manhole opening formed by the form. A peripheral form piece is also provided for forming a recess or a manhole cover.

It appears that the Mitchell form is time-consuming to install and remove.

Other apparatus for forming concrete curb openings are shown in U.S. Pat. Nos. 3,436,051, 4,085,918, and 4,119,291.

Each of these previous drain forms is somewhat expensive to use. A need therefore exists for an improved apparatus for forming curb inlet drains in situ which is directed towards overcoming this and other disadvantages of prior art devices.

SUMMARY OF THE INVENTION

The present invention comprises a disposable concrete curb inlet drain form for use in casting curb inlet drains in situ. The form includes a base which molds the main body of the curb inlet drain, and a neck which projects upwardly from the base to form a manhole opening. The base is made of a lightweight frangible material capable of being broken into pieces and removed from the drain through the manhole opening after the inlet drain is formed. The neck may also be made of a frangible material.

In accordance with a more specific aspect of the invention, the base and neck are separate unitary pieces which are selectively held together as concrete is poured around the form and dries. The neck can therefore be removed from the curb inlet drain first to enlarge the opening through which the base of the form can then be removed.

As still another aspect of the present invention, the front wall of the form has a downwardly sloped lower face which molds an inclined surface along which water can flow into the curb inlet drain after the form is removed. The front sidewalls of the drain form are also sloped inwardly such that the curb inlet drain opening will have inwardly sloping sidewalls that help direct water into the inlet opening.

In a preferred embodiment of the invention, the drain form is made of an inexpensive, lightweight material such as expanded polystyrene, which is sold under the trademark STYROFOAM.

It is accordingly an overall object of the present invention to provide an improved form for manufacturing curb inlet drains in situ.

It is still another object of the present invention to provide such a form which is relatively inexpensive and in one form is disposable.

A further object of the present invention is to provide such a form which is lightweight, and is easy and fast to install and remove.

Still another object of the present invention is to provide such a form which may be installed and removed by a single individual without requiring a boom truck or other expensive load handling equipment.

These and other objects, features and advantages of the present invention will become apparent with reference to the following description and drawings.

BRIEF DESCRIPTION OF THE DRAWINGS

FIG. 1 is an isometric view of a concrete curb inlet drain form in accordance with the present invention in place, dashed lines indicating concrete poured about the form to provide a curb inlet drain.

FIG. 2 is a side elevational view of the form of FIG. 1 in an assembled condition prior to the pouring of concrete.

FIG. 3 is a top plan view of the form shown in FIG. 2, the form having been rotated ninety degrees and a pair of reinforcing boards having been placed in the neck to help hold it in place.

FIG. 4 is a cross sectional view taken along lines 4—4 of FIG. 3.

DETAILED DESCRIPTION OF A PREFERRED EMBODIMENT

With reference to the figures, and in particular to FIG. 1, the illustrated curb inlet drain form 10 is shown in place with concrete 12 poured about the form. After the concrete is set, the form is removed, as explained below, leaving the concrete curb inlet drain cast in place. When the form 10 is removed, a metal manhole cover supporting rim 16 remains in place, embedded in the concrete. Except for the rim, the entire form 10 may be disposable.

Form 10 includes a rectangular base 20 having a flat top 22, flat sidewalls 24, 26, flat rear wall 28 and front wall 30 which together define a box-like, rectangular enclosure 32 (FIGS. 2 and 4) within form 10. Top 22 defines a circular opening 23 (FIG. 2) which spans most of the area of top 22. The front half 25 of top 22 slopes upwardly to an elevated lip 27 which is slightly higher than the level of top 22. Front wall 30 of base 20 forms a concave arc 34 (FIG. 1) which curves upwardly and outwardly away from the body of base 20, and then forms a vertical flat face 36 which projects upwardly to lip 27. Base 20 is preferably unitary and of a lightweight frangible material, such as 1.9 pound/ft$^2$ density expanded polystyrene. Therefore, base 20 can readily be broken by a user even by hand, and removed as explained below through opening 23 after the curb inlet drain is formed.

A separate, optional wing 42 is nailed or pinned to the front corner of sidewall 24. Wing 42 includes a concave lower face 44 (FIGS. 1, 2 and 4) which has the same curvature as arc 34 and is aligned therewith. Wing 42 further includes a concave sidewall 46, a flat inner wall (not shown) which fits flush against flat sidewall 24, and a flat front wall 48 which is the same width as vertical face 36 and fits alongside face 36 to form an extension thereof. Wing 42 also has a flat top 49 (FIGS. 1 and 3) which provides a coplanar extension of the sloped front half 25 of top 22 when wing 42 is in place. Top 49 is somewhat right triangular in shape, with the top edge of concave sidewall 46 defining an arcuate base of the right triangle formed by top 49.

Another wing 50, which is the mirror image of wing 42, is similarly attached near the front corner of sidewall 26 and has a concave lower face 52 (FIG. 4) aligned with arc 34, a concave sidewall 54, and a flat inner wall (not shown) which fits flat against sidewall 26. Wing 50 also includes a flat top 56 which slants upwardly coplanar with front half 25 of top 22, and a front wall 58, which is the same width as face 36 and extends sidewardly therefrom when wing 50 is in place at the front corner of base 22.

Although not required, both of the wings 42, 50 are also typically made of expanded styrene so that they can be broken and easily removed.

Form 10 also includes a neck 60, which can be molded or otherwise formed as a separate piece from base 20. The neck 60 is used to form a manhole opening 62. Neck 60 projects upwardly from base 20 and includes a large diameter top ring 64, an intermediate diameter middle ring 66 (FIG. 4), and a small diameter lower ring 68. In the disclosed embodiment, rings 66, 68 are formed of a frangible material, such as used for base 20, and comprise a single molded piece, while ring 64 is separately molded of this material and positioned on top of ring 66. In other embodiments, all three rings 64–68 can be molded separately as three pieces or together as a single unitary neck member. In yet other embodiments, neck 60 can be made of a durable, nonfrangible plastic such that neck 60 can be reused.

The inner faces of rings 64–68 cooperatively form a smooth wall inner face 70. Rings 66, 68 cooperatively form a right angle shoulder 69 around the bottom periphery of neck 60 that provides a stop for supporting neck 60. The rings are dimensioned such that lower ring 68 fits snugly within opening 23 in the top of base 10, and the middle ring 66 rests on flat top 22 around opening 23.

The metal band 16 fits snugly around and is frictionally retained against the outer vertical face of top ring 64. Band 16 provides a surface on which a manhole cover (not shown) rests after the curb inlet drain is formed.

Neck 60 is secured to base 20, such as by a plurality of nails 72 (FIG. 4) which are driven through the inner face 70 of neck 60.

In the illustrated embodiment, base 20 has a square cross section with a width longer than the outside diameter of neck 60.

In use, the form is assembled by placing lower ring 68 of neck 60 into opening 23 of top 22 until middle ring 66 rests on top 22 around opening 23. Nails 72 are then driven through lower ring 68 into top 22 to secure neck 60 to base 20. Ring 64 is placed on top of ring 66 and fixed in place by nails or glue (not shown). Wings 42, 50 are also secured to base 20. Form 10 is then positioned over a drain which has already been dug in the ground. A short board 76 (FIG. 4), which is longer than the diameter of opening 23 but shorter than the width of base 20, is inserted through ring 60 and positioned flat against the bottom face of top 22 and ring 68. A longer board 78 (FIG. 4), which is longer than the outer diameter of ring 64, is then positioned flat against the top face of ring 64. Tension wires 80, 82, which are wrapped around and interconnect boards 76, 78, are tightened by twisting each wire such that boards 76, 78 are moved closer to each other, and compress neck 60 against top 22 of base 20 to stabilize the neck against dislodgement as concrete is poured. A facing board (not shown) is placed against face 36 and in position to form the face of a curb section adjoining the curb inlet drain. Also, a metal angle iron nosing (not shown, but like the nosing shown in U.S. Pat. No. 4,637,585 of Picollo) is typically either clamped to this facing board or rests on the upper front edge of the form in a position to protect the upper edge of the curb inlet drain opening after the curb inlet drain is poured. Concrete 12 is then poured around form 10 to cover all of it.

After the concrete has set, tension wires 80, 82 are loosened or cut, and boards 76, 78 are removed. Form 10 is then broken into pieces by fracturing the frangible form 10 into pieces and removing them through opening 62. This assumes the neck and base are each of a breakable material. The form can be fractured manually by grasping portions of the mold and pulling. Alternatively, a chisel or other tools can be used to break the mold into pieces.

Neck 60 is preferably removed first, which thereby provides a larger opening for reaching down into the formed drain to fracture and remove base 20. If neck 60 is reusable, it is typically formed of plastic or some other durable material and is lifted from the curb inlet drain for subsequent reuse. In contrast, if neck 60 is of a frangible material, it is typically fractured and removed. Base 20 is then broken into pieces which are small enough to be removed through manhole opening 62. An expanded polystyrene material, such as STYROFOAM, is an especially preferred material of which to make form 10 because it does not adhere to dried concrete. Form 10 therefore need not be lubricated prior to use, as is required with curb inlet drain forms made of some other materials. A STYROFOAM form has the great advantage of being easily broken into pieces and removed after use without the necessity of pretreatment.

STYROFOAM is a widely used material which is inexpensive and easy to mold. Use of this material therefore reduces the cost of making form 10, which in turn decreases the cost of materials needed to form a curb inlet drain. The lightweight form is easily lifted by one individual without the need for cranes or other heavy equipment, further decreasing the cost of construction. Also, the rapidity with which the form is assembled, used and removed decreases the amount of time and cost of labor required to construct the curb inlet drain. In addition, such forms are lightweight and therefore relatively inexpensive to transport. Also, the use of a two piece form facilitates shipment of the neck and base in a compact package.

Many of the same advantages can be obtained with other frangible materials besides STYROFOAM. The term "frangible," as used herein, refers to a material which can be crumbled or fractured without applying excessive force.

Having illustrated and described the principles of our invention with reference to one preferred embodiment, it should be apparent to those persons skilled in the art that such invention may be modified in arrangement and detail without departing from such principles. We claim as our invention all such modifications as come within the true spirit and scope of the following claims.

We claim:

1. A drain form for forming a curb inlet drain having a main body, comprising:

a base means for forming the main body of the curb inlet drain, including inlet opening formation means for forming a drain inlet opening, wherein the inlet opening formation means includes a front portion having a flat front face and sidewalls sloped inwardly from the front face; and a neck means for forming a manhole opening, the neck means projecting upwardly from the base means;

wherein the base means is made of a frangible material capable of being broken into pieces and removed from the drain after curb inlet drain formation, and wherein the front portion comprises a pair of separate wing portions mounted to the base means to provide the inwardly sloped sidewalls.

2. A disposable form for forming a concrete curb inlet drain for a water catch basin, comprising:

a frangible base means for forming a main body of the inlet drain, the base means having a front portion including an inlet opening formation means for forming an inlet extending from a curb inlet drain opening to the catch basin, the inlet opening formation means having a bottom wall which slopes downwardly from the curb inlet drain opening to the catch basin; and a separate frangible neck means for mounting to the base means and for forming a manhole opening, the neck means projecting upwardly from the base means.

3. The drain form of claim 2 in which the inlet opening formation means also has sidewalls which are spaced a first distance apart at the curb inlet drain opening and a second shorter distance apart at a location toward the catch basin from the curb inlet opening to thereby narrow inwardly toward the catch basin.

4. A disposable form for forming a concrete curb inlet drain for a water catch basin, comprising:

a frangible base means for forming a main body of the inlet drain, the base means having a front portion including an inlet opening formation means for forming an inlet extending from a curb inlet drain opening to a catch basin, the inlet opening formation means having a bottom wall which slopes downwardly from the curb inlet drain opening to the catch basin and which is concave;

a separate frangible neck means for mounting to the base means and for forming a manhole opening, the neck means projecting upwardly from the base means; and a pair of frangible wings attachable to opposing sides of the front portion, each wing having a concave lower face alignable with the concave bottom wall of the base means and a concave sidewall.

5. A disposable form for forming a concrete curb inlet drain for a water catch basin, comprising:

a rectangular frangible base means for forming a main body of the inlet drain, the base means having a flat top with a circular top opening therethrough, a vertical face, and a concave front portion below the vertical face;

a pair of separate frangible wings attachable to opposing sides of the front portion, each wing having a concave lower face alignable with the concave front portion of the base means, and a concave sidewall;

a separate frangible neck means for forming a manhole opening, the neck means projecting upwardly front the base means and having a large diameter annular top portion, an intermediate diameter annular middle portion smaller in diameter than the top portion, and a small diameter annular lower portion smaller in diameter than the middle portion, the lower portion being dimensioned to fit within the top opening and the middle portion being dimensioned to fit on top of the base around the top opening; and attachment means for selectively holding the base means and neck means together during inlet drain information.

6. The drain form of claim 5 also including a metal band around the neck means for forming a support ring for a manhole cover.

7. A drain form for forming a curb inlet drain having a main body, comprising:

a base means for forming the main body of the curb inlet drain, including inlet opening formation means for forming a drain inlet opening having a front portion with a flat front face and sidewalls, the front portion including a pair of separate wing portions mounted to the base means to provide the sidewalls; and a neck means for forming a manhole opening, the neck means projecting upwardly front the base means;

wherein the base means is made of a frangible material capable of being broken into pieces and removed from the drain after curb inlet drain formation.

8. A drain form for forming a curb inlet drain having a main body, comprising:

a base means for forming the main body of the curb inlet drain, including inlet opening formation means for forming a drain inlet opening having a front portion with a flat front face and sidewalls, the front portion including a pair of wing portions protecting from the base means to provide the sidewalls; and a neck means for forming a manhole opening, the neck means projecting upwardly from the base means;

wherein the neck and base means are made of a frangible material capable of being broken into pieces and removed from the drain after curb inlet drain formation.

9. A drain form for forming a curb inlet drain having a main body, comprising:

a base means for forming the main body of the curb inlet drain, including inlet opening formation means for forming a drain inlet opening having a front portion with a flat front face and sidewalls, the front portion including a pair of separate wing portions mounted to the base means to provide the sidewalls, wherein the base means is made of a frangible material capable of being broken into pieces and removed from the drain after curb inlet drain formation, and wherein the inlet opening formation means sidewalls are spaced a first distance apart at the curb inlet drain opening and a second shorter distance apart at a location toward the catch basin from the curb inlet opening to thereby narrow inwardly toward the catch basin; and a neck means for forming a manhole opening, the neck means projecting upwardly from the base means.

10. A drain form for forming a curb inlet drain in situ together with concrete surrounding the drain form to form the curb inlet drain, the curb inlet drain having a main body, comprising:

a base means for forming the main body of the curb inlet drain, including inlet opening formation means for forming a drain inlet opening, including a downwardly sloped front lower wall and a front portion having a flat front face and inwardly sloped sidewalls, wherein the front portion comprises a pair of separate wing portions mounted to the base means to provide the inwardly sloped sidewalls, and wherein the base means is made of a frangible material capable of being broken into pieces and removed from the drain after curb inlet drain formation;

a neck means for forming a manhole opening, the neck means projecting upwardly from the base means; and concrete covering at least a portion of the drain form, the concrete having a sidewalk forming upper surface through which the manhole opening extends, the concrete also having a curb inlet defining front surface through which the curb inlet drain extends.

* * * * *

UNITED STATES PATENT AND TRADEMARK OFFICE

CERTIFICATE OF CORRECTION

PATENT NO. : 4,957,268

DATED : September 18, 1990

INVENTOR(S) : Picollo et al.

It is certified that error appears in the above-identified patent and that said Letters Patent is hereby corrected as shown below:

Column 6, line 42; "front" should be --from--;

Column 6, line 53; "information" should be --formation--;

Column 6, line 67; "front" should be --from--;

Column 7, line 12; "protecting" should be --projecting--.

Signed and Sealed this

Eighth Day of September, 1992

*Attest:*

DOUGLAS B. COMER

*Attesting Officer*

*Acting Commissioner of Patents and Trademarks*